United States Patent [19]

Lee et al.

[11] Patent Number: 4,492,602

[45] Date of Patent: Jan. 8, 1985

[54] COPPER BASE ALLOYS FOR AUTOMOTIVE RADIATOR FINS, ELECTRICAL CONNECTORS AND COMMUTATORS

[75] Inventors: Yung W. Lee; Fu W. Ling, both of Edison; Stanley Shapiro, Hillside, all of N.J.

[73] Assignee: Revere Copper and Brass, Inc., New York, N.Y.

[21] Appl. No.: 513,280

[22] Filed: Jul. 13, 1983

[51] Int. Cl.[3] ..... C22C 9/02; C22F 1/08

[52] U.S. Cl. ..... 148/11.5 C; 148/12.7 C; 148/433; 420/470; 420/500

[58] Field of Search ..... 420/500, 470, 473, 476; 148/11.5 C, 12.7 C, 412, 433

[56] References Cited

U.S. PATENT DOCUMENTS

| | | | |
|---|---|---|---|
| 2,027,807 | 1/1936 | Burghoff et al. | 420/470 |
| 2,038,136 | 4/1936 | Smith | 420/477 |
| 2,052,523 | 8/1936 | Wilkins | 420/470 |
| 2,178,508 | 10/1939 | Zickrick | 420/491 |
| 2,239,179 | 4/1941 | Hensel et al. | 420/495 |
| 2,286,734 | 6/1942 | Harrington | 148/412 |
| 2,768,891 | 10/1956 | Gardner et al. | 420/470 |
| 3,383,198 | 5/1968 | Shafter | 420/500 |
| 3,497,272 | 2/1970 | Caubet | 420/500 |
| 3,574,609 | 4/1971 | Finlay et al. | 148/11.5 C |
| 3,649,254 | 3/1972 | Servi | 420/470 |
| 4,264,360 | 4/1981 | Parikh et al. | 420/470 |
| 4,311,522 | 1/1982 | Bafra | 148/11.5 C |

FOREIGN PATENT DOCUMENTS

| | | | |
|---|---|---|---|
| 2211678 | 9/1973 | Fed. Rep. of Germany | 260/544 K |
| 104447 | 8/1980 | Japan | 148/11.5 C |

OTHER PUBLICATIONS

Woollaston et al., "High Conductivity Copper Alloy Forgings and Stampings 38 , Metallurgia and Metal Forming, Mar. 1977, pp. 100–104.

Mendenhall, *Understanding Copper Alloys,* Olin Corporation, East Alton, Illinois, 1977, p. 66.

*Primary Examiner*—Peter K. Skiff

*Attorney, Agent, or Firm*—Pennie & Edmonds

[57] ABSTRACT

The present invention relates to novel tin bearing copper alloy compositions that possess a combination of high anneal resistance and high electrical cconductivity properties. These compositions contain about 0.025 to 0.15 weight percent free tin with a weight percent of combined tin that is 3.7 times the oxygen content. Selenium and/or tellurium additions of from 0.005 to 0.05 weight percent also contribute to or maintain the improved properties of the present invention.

Other aspects of the invention relate to a process for preparing these anneal resistant, high electrical conductivity copper alloy compositions and an apparatus suitable for use as radiator fin, electrical connector, or commutator segment stock which is formed by such process.

24 Claims, 4 Drawing Figures

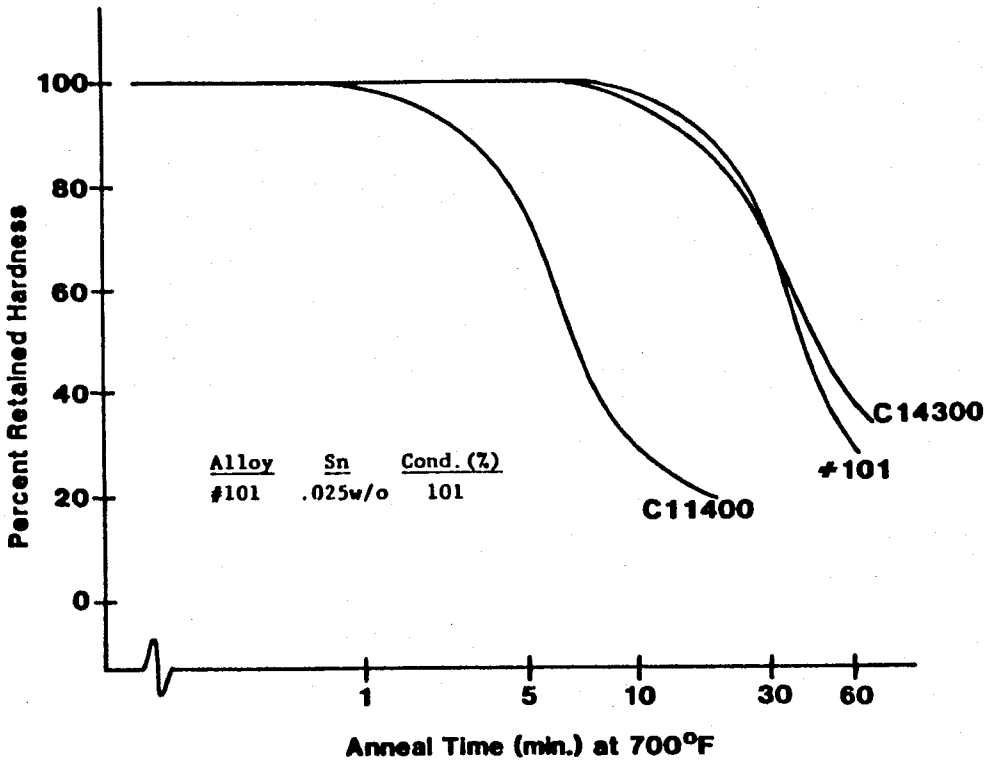
Figure 1: Anneal resistance of tin-bearing coppers as compared with that of C11400, and C14300.

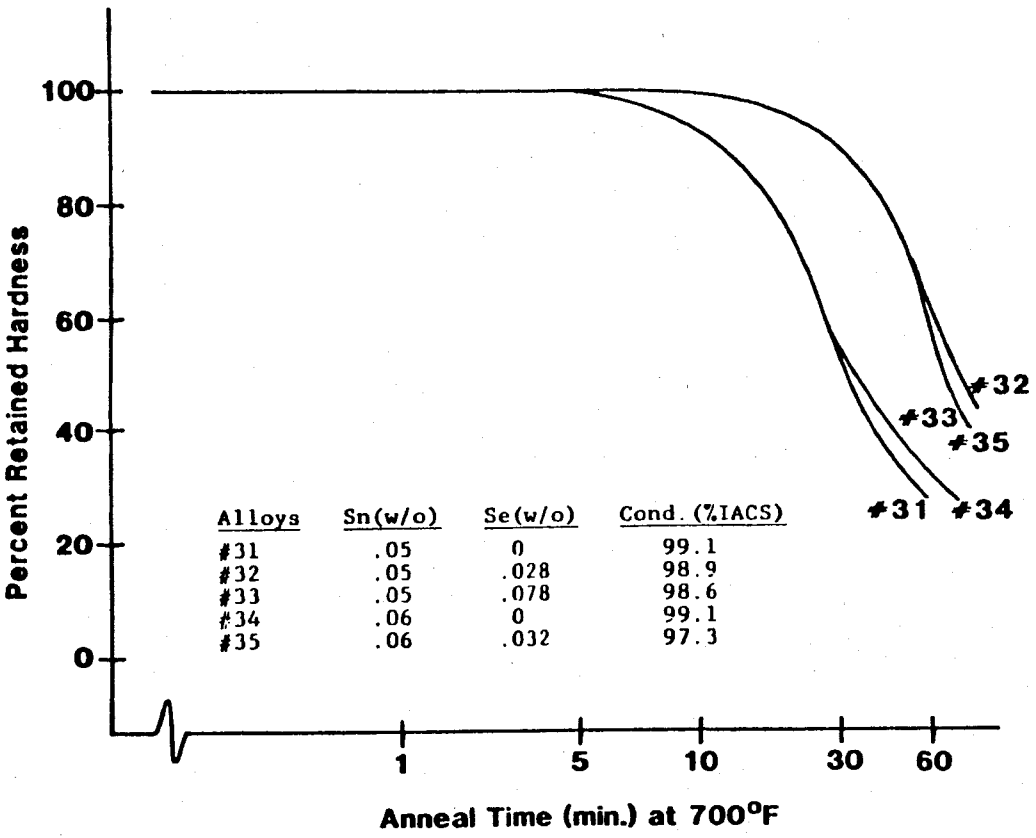
Figure 2: Effect of Selenium on anneal resistance and conductivity of tin-bearing copper.

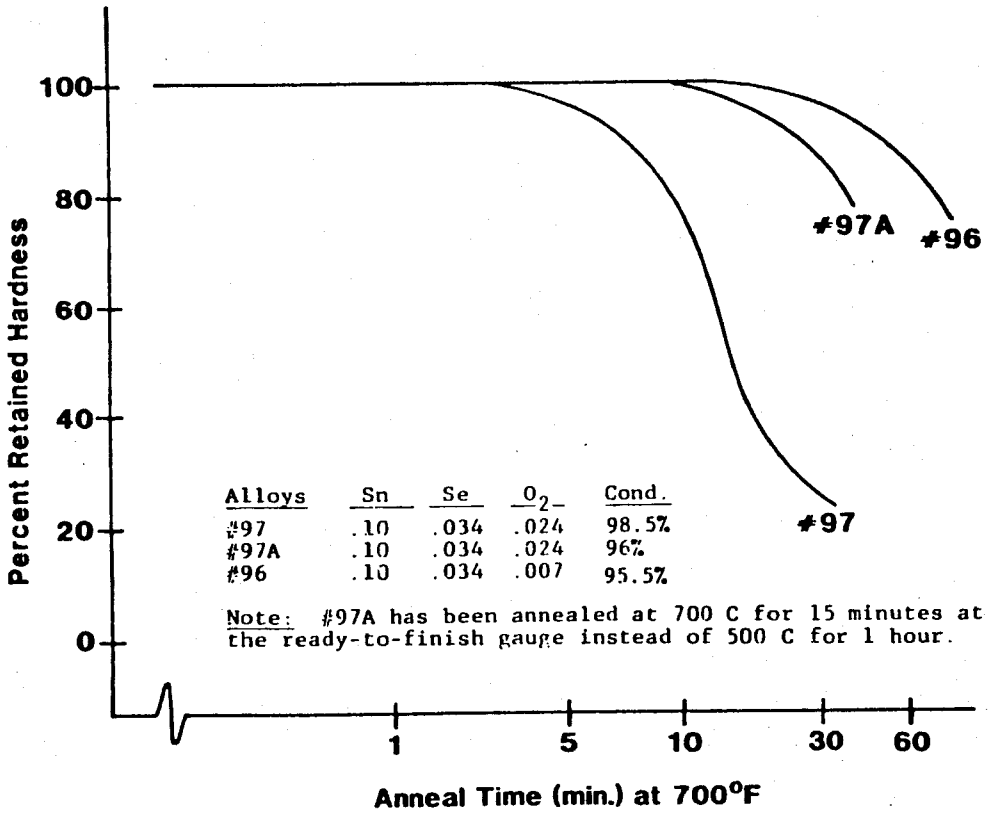
Figure 3: Effect of anneal temperature at the ready-to-finish gauge on anneal resistance of Cu-Sn-Se alloy.

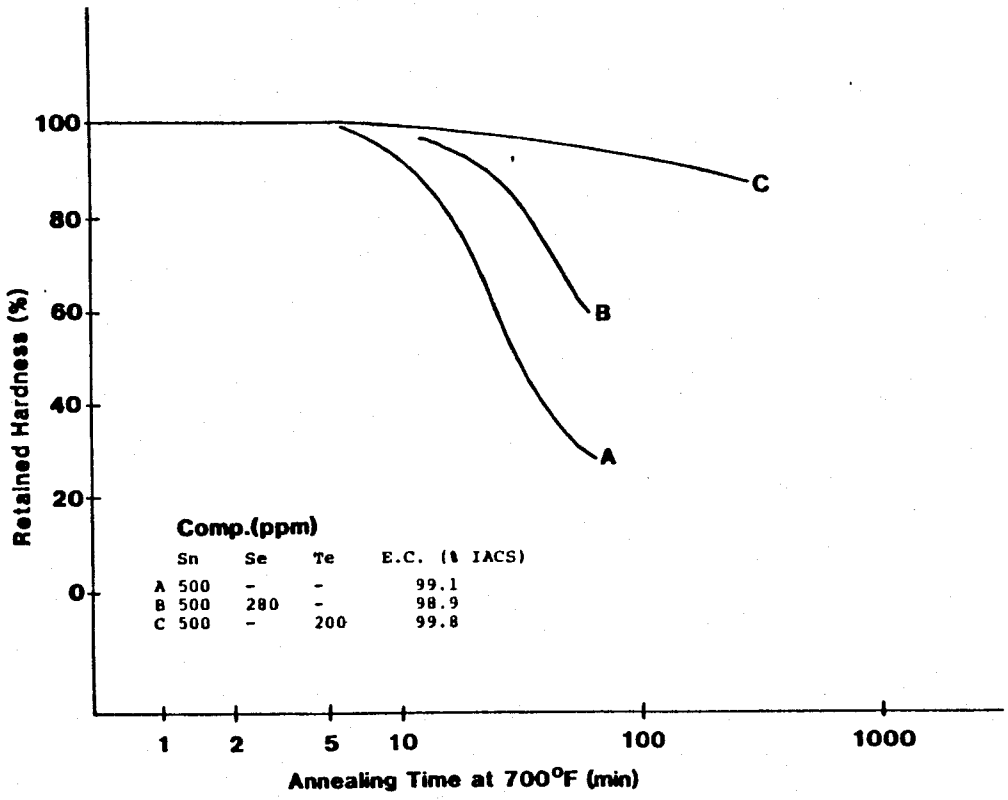
Figure 4: Relative comparison in conductivity and anneal resistance of Cu-Sn, Cu-Sn-Se and Cu-Sn-Te alloys.

COPPER BASE ALLOYS FOR AUTOMOTIVE RADIATOR FINS, ELECTRICAL CONNECTORS AND COMMUTATORS

Technical Field

The present invention relates to novel tin bearing copper alloy compositions that possess a combination of high anneal resistance and high electrical conductivity properties. The specific alloying elements used in these compositions also provide adequate strength and formability such that they are particularly suitable for applications in automotive radiator fin stock, electrical connectors, and commutator segments.

Background Art

As a material of construction, copper and copper alloys constitute one of the major groups of commercial metals. They are widely used due to their excellent electrical and thermal conductivity, good corrosion resistance, adequate strength, an ease of fabrication.

It is known that the addition of alloying elements to pure copper invariably decreases electrical conductivity and, to a lesser extent, thermal conductivity. For this reason, pure copper or alloys having a very high copper content are preferred over other copper base alloys which contain more than a few percent of total alloy content for applications where high electrical or thermal conductivity is required. The extent that the conductivity is reduced due to alloying does not depend on the conductivity or any other bulk property of the alloying element, but only on the effect that the particular foreign atoms have on the copper lattice.

Commercially pure coppers are designated by the Unified Numbering System (UNS) by numbers from C10100 to C13000. The various coppers within this group have different degrees of purity and therefore slightly different properties. All of these alloys, however, are primarily designed for applications requiring high electrical or thermal conductivity, and some examples follow.

Fire refined tough pitch copper C12500 is made by deoxidizing anode copper until the oxygen content has been lowered to the optimum value of 0.02 to 0.04%. This alloy also contains a small amount of residual sulfur, normally 10 to 30 ppm, and a somewhat larger amount of cuprous oxide, normally 500 to 3000 ppm. C12500 is characterized as having a minimum electrical conductivity of 95% that of the International Annealed Copper Standard (IACS), which is arbitrarily set at 100%.

Electrolytic tough pitch copper, designated C11000, is the most common of all the electrical coppers, because it is easy to produce and has an electrical conductivity in excess of 100% IACS. While it also has the same oxygen content as C12500, it differs in sulfur content and over-all purity.

Oxygen-free, high purity coppers C10100 and C10200 have exceptional ductility, low gas permeability, freedom from hydrogen embrittlement, and a low out-gassing tendency, and are also particularly suitable for applications requiring high conductivity.

Despite their excellent electrical conductivities, all of the aforementioned high purity copper or copper-oxygen alloys possess marginal anneal resistance.

If an improved anneal resistance (i.e., resistance to softening at elevated temperatures) is required, however, C11100 is often specified. This copper alloy contains small amounts of cadmium or other elements, which raise the temperature at which recovery and recrystallization occur. Oxygen-free copper, electrolytic tough pitch copper, and fire refined tough pitch copper are also available as silver-bearing coppers having specific minimum silver contents. These cadmium or silver additions impart an improved anneal resistance to the cold worked metal, thus making these alloys useful for applications such as automotive radiators and electrical conductors that must operate at temperatures above about 200° C.

If good machinability is required in an alloy with improved anneal resistance, C14500 (tellurium-bearing copper) or C14700 (sulfur-bearing copper) can be used. Examples of these type alloys can be found in U.S. Pat. Nos. 2,027,807, 2,038,136, and 2,052,053. As might be expected, however, the improvement in machinability is gained at a modest sacrifice in electrical conductivity.

Because these high copper content alloys are very soft an ductile in the annealed condition, they possess relatively low mechanical strength. To improve strength and hardness, mechanical working of these alloys is employed.

Cold working increases both tensile strength and yield strength, but the effect is more pronounced on the latter. For most copper alloys, the tensile strength of the hardest cold worked temper is approximately twice the tensile strength of the annealed temper. For the same alloys, the yield strength of the hardest cold worked temper may be as much as five times that of the annealed temper.

However, the improvement in mechanical strength due to cold working can be reversed if the metal is heated after cold working. As mentioned above, the addition of small amounts of elements such as silver and cadmium imparts resistance to this softening phenomenon so that the alloys are more useful for applications which would be subject to subsequent heating. Such applications include, for example, the soldering operations used to join components of automobile or truck radiators.

The thermal and electrical conductivities of copper are relatively unaffected by small amounts of either silver or cadmium. Room temperature mechanical properties also are unchanged. C11100, C14300, and C16200 (cadmium-bearing coppers), however, do work harden at higher rates than either C11400 (silver-bearing copper) or C11000 (electrolytic tough pitch copper).

Cold rolled silver-bearing copper and cadmium-bearing copper have been used extensively for automobile radiator fins. Usually silver-bearing copper strip is only moderately cold rolled, because heavy cold rolling makes the alloy more likely to soften to a greater extent during soldering or other heating operations. Some manufacturers prefer cadmium copper C14300, because it can be severely cold rolled without this susceptibility to softening during subsequent heating operations.

There are certain disadvantages in using these prior art alloys. Silver-bearing coppers are expensive due to their silver content and cadmium copper presents environmental and health problems during melting, casting, and welding due to the generation of hazardous cadmium fumes. To avoid these problems, therefore, the development of alternate alloys has been attempted.

Since the alloying elements added to improve the anneal resistance of copper usually reduce its conductivity, the minimum concentrations of the alloy additions are dictated by the minimum anneal resistance requirement for the application. Similarly, the maximum concentrations allowed are determined by the minimum requirement of conductivity.

It is known that tin additions to copper raise the softening of annealing temperature. U.S. Pat. No. 3,649,254 discusses copper alloys containing 0.2 to 0.4 weight percent tin and 0.01 to 0.06 weight percent oxygen. While this patent does provide copper alloy compositions with better anneal resistance, these improvements are obtained at a loss of electrical conductivity, particularly at the higher tin contents.

Another novel alloy for automotive radiator fins which has been extensively used by the Japanese is a copper-phosphorus-tin alloy, C14410. The alloy contains 0.10 to 0.2 weight percent tin to improve anneal resistance and 0.005 to 0.02 weight percent phosphorus added mainly for deoxidizing. The addition of phosphorus, however, causes a severe reduction of the electrical conductivity of this alloy.

Therefore, none of the prior art discloses alloy compositions that can replace silver or cadmium bearing copper alloys while retaining a combination of improved anneal resistance (similar to C11400 or C14300), high electrical conductivity (90% IACS, minimum), low cost effectiveness, and easy fabricating and processing capabilities. The present invention resolves the difficulties of the prior art through copper alloy compositions that can effectively achieve the foregoing advantages.

Further benefits and advantages of the present invention will become apparent from a consideration of the following description given with reference to the accompanying drawing figures which show the surprising improvements of preferred embodiments of the present invention.

BRIEF DESCRIPTION OF THE DRAWINGS

FIG. 1 is a graph of the anneal resistance of a tin-bearing copper alloy of the present invention compared to prior art alloys;

FIG. 2 is a graph of the anneal resistance of various tin-selenium-copper alloys according to the invention;

FIG. 3 is a graph of the anneal resistance of further tin-selenium-copper alloys according to the invention; and FIG. 4 is a graph of the anneal resistance of the alloys of the invention compared to those of the prior art.

Disclosure of the Invention

One object of the present invention is to provide copper alloys that have an electrical conductivity and anneal resistance similar to silver-bearing or cadmium-bearing copper. The major novelty of these copper alloy compositions is that they can tolerate the presence of oxygen so that deoxidizers are not needed to achieve the desired properties.

In one aspect of the present invention, these alloys contain a tin content which is dependent upon the oxygen content according to the formulas listed below for the desired electrical conductivity and an anneal resistance equivalent to cadmium copper.

(A) For 90% IACS (min.)

$$\text{Sn ppm} = 870 \text{ ppm} \pm 620 \text{ ppm} + (3.7)\ (O_2 \text{ ppm})$$

(B) For 95% IACS (min.)

$$\text{Sn ppm} = 525 \text{ ppm} \pm 275 \text{ ppm} + (3.7)\ (O_2 \text{ ppm})$$

When the oxygen content is low, an addition of as low as 0.025 weight percent free tin can produce an anneal resistance of the alloy that is equivalent to that of cadmium-bearing copper, while maintaining an electrical conductivity of between 95 and 101% IACS.

Similarly, the maximum tin addition would be 0.15 weight percent for a minimum electrical conductivity of 90% IACS, and 0.09 weight percent for a minimum electrical conductivity of 95% IACS.

For copper alloys that contain oxygen, the extra tin required will be 3.7 times the oxygen content in order to allow the oxygen to form tin oxide while retaining the free tin for improving the anneal resistance. The relationship between the tin and oxygen content in order to achieve the desired conductivity is expressed above in Equations A and B.

In another aspect of the invention selenium is added to these copper-tin alloys. As little as 0.005 weight percent selenium further improves the anneal resistance of the alloy with a very slight, almost negligible reduction in electrical conductivity, thus imparting properties to the alloy composition that are equal to or better than those for cadmium-bearing copper, while avoiding the generation of hazardous fumes during subsequent heating operations.

These selenium additions are of greater importance when the copper alloy has a low free tin content (i.e. either low in tin or high in oxygen). As high as 0.05 weight percent can be added without affecting the high conductivity or improved anneal resistance of these novel alloy compositions. It is also possible to achieve even better anneal resistance by subjecting the alloy to a higher anneal temperature during processing. This improvement is believed to be due to the increase in the degree of selenium solid solution in the copper matrix.

Another aspect of the invention includes the addition of tellurium to the copper-tin alloys instead of selenium. Although selenium and tellurium are found in similar positions and the same column of the periodic table, it was found that small additions of tellurium produced a far superior increase in the anneal resistance of copper-tin alloys. It was also found that tellurium additions in the range of 0.005 to 0.05 weight percent have no adverse effect on the electrical conductivity of these copper alloys. Furthermore, the anneal resistance of these copper-tin-tellurium alloys is not affected by presence of oxygen as are the copper-tin alloys. The remarkable anneal resistance of this copper-tin-tellurium alloy renders it particularly suitable as a high technology alloy for applications where stringent anneal resistance is required.

It is also possible to add selenium and tellurium in combination to achieve the foregoing advantages.

An additional advantage of the present invention is its ability to tolerate certain levels of iron and/or zinc as impurity elements without affecting the improved anneal resistance or high electrical conductivity properties. Amounts of up to about 0.02 weight percent iron and up to about 0.2 weight percent zinc can be present without changing the improved properties of the claimed alloy compositions.

The processing of copper-tin or copper-tin-selenium alloys requires no new technology, however, certain precautions are required. In the preparation and melting of these alloys, the oxygen concentration in the molten copper should be estimated so that the proper amount of tin can be added. For example, a bath with a higher oxygen content requires a higher tin addition in order to allow part of the tin content to become tin-oxide upon solidification. Copper-tin-tellurium alloys are less sensitive to the presence of oxygen and can be processed more easily.

Another object of the invention is a process for preparing these anneal resistant, high electrical conductivity copper alloys. This process includes (a) melting a copper base metal (as in any melting operation, a quantity of oxygen will be present in the molten metal),
(b) estimating the oxygen content of the molten copper to determine the amount of alloying elements to be added,
(c) adding the proper amount of alloying elements,
(d) casting the alloy composition by conventional methods,
(e) heating the cast alloy for a sufficient time to achieve the desired hot working temperature range,
(f) hot working the heated alloy at a temperature range of from 400° C. up to within 50° C. of the melting temperature of the alloy, to a reduced section thickness of up to 95%,
(g) cold rolling the hot worked alloy to a reduced section thickness of up to 95%, and
(h) conducting an intermediate anneal of the cold rolled alloy for a time between 10 seconds and 12 hours at a temperature range of 300° to 850° C.

If desired, the annealed alloy can be cold rolled to a reduced section thickness of up to 90% to achieve a finish dimension. Also, steps (g) and (h) can be repeated as many times as necessary to achieve a desired thickness.

In the preparation and melting of the alloys, an accurate assessment of oxygen concentration in the molten bath is preferred for a successful alloy. A good assessment provides a basis for determining the amount of tin required. With modern oxygen analyzers, a quick and accurate measurement of oxygen can be accomplished during melting and casting operations.

The alloy additions of tin, selenium, and tellurium are quite stable during normal melting practice. No detectable loss of tin and selenium is seen up to 3 hours in a laboratory melt in which graphite covers are used and oxygen concentration was maintained below 100 ppm. This is because that at the normal melting temperatures, tin will only form oxide when the oxygen concentration is extremely high, such as 1–2 weight percent (10,000–20,000 ppm). Upon solidification, however, solubility of oxygen in the alloy drastically decreases and, since tin is less noble than copper, it will form oxide at much lower oxygen concentrations. Selenium and tellurium are more noble than tin, and copper, so that they should not form oxide as easily.

Hot rolling may be performed at a temperature range of 400° C. to within 50° C. of the melting point of the alloy, and preferably at 800°–900° C. A cold reduction of 95% can be achieved without difficulty, however, cold-roll reduction may be specified as low as 10% for certain applications where formability is a concern.

The copper-tin compositions can be annealed at any temperature between 300° C. and 850° C. for a sufficient time to achieve the desired grain size. The copper-tin-selenium and copper-tin-tellurium compositions can also be annealed under these conditions but it is preferable to anneal at temperatures above 500° C. because higher annealing temperatures improve the anneal resistance.

Generally, temperatures between 300° C. and 850° C. at times from 10 seconds and 12 hours are used for an intermediate anneal of the alloys of the present invention. When higher temperatures are used, the holding time is generally shorter, and the converse is also true (i.e., the lower the temperature, the longer the holding time). As mentioned previously, the intermediate anneal temperature should be above 500° C. for the copper-tin-selenium or copper-tin-tellurium compositions in order to develop the optimum anneal resistance.

Another aspect of the present invention relates to the use of these anneal resistant, higher conductivity copper alloy compositions as apparatus such as radiator fin stock, electrical connectors, or commutator segments. These apparatus advantageously utilize the improved properties of the present compositions for the intended applications. Also, the present compositions avoid the high cost of silver-copper alloys, the environmental problems associated with cadmium-copper alloys, and the inferior conductivity or anneal resistance of other prior art alloys.

Examples

A further understanding of the present invention, and the advantages thereof, can be had by reference to the following examples.

Alloys with various compositions were melted by induction heating in a clay-graphite crucible. High purity cathode copper and commercially pure tin, selenium, and tellurium were used. Graphite powder was used as a cover for most melts. Since alloys melted with a graphite cover usually resulted in very low oxygen contents of the composition (<90 ppm), magnesium oxide powder was used for preparing alloys with higher oxygen contents. The molten metals were statically cast in a graphite mold to 1" thick slabs. They were heated to 850° C. over a 2 hour period, hot rolled to 0.275" and then cold rolled to 0.065". The samples were annealed at 500° to 550° C. for one hour and then cold rolled to 0.040', which is equivalent to a full hard temper, for the anneal resistance test.

The composition and conductivity of the new copper alloy compositions are tubulated in Tables I, II, and III. The mechanical properties of these alloys are shown in Table IV.

Example 1

The superior anneal resistance of a copper alloy comprised of 0.025 weight percent tin is compared to that of C11400 and C14300 in FIG. 1.

Example 2

The anneal resistance and conductivity of the new copper-tin-selenium alloys is shown in FIG. 2.

Example 3

FIG. 3 shows the improvement in anneal resistance of a copper-tin-selenium alloy that was annealed at a higher temperature.

Example 4

The relative comparison the conductivity and anneal resistance for copper-tin, copper-tin-selenium, and copper-tin-tellurium is shown in FIG. 4.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as full within the true spirit and scope of the present invention.

TABLE I

Composition and Conductivity of the Copper-Tin Alloys

| Alloy No. | Composition (wt. %) Sn | $O_2$ | Conductivity (% IACS) Annealed | Cold Rolled | Anneal Resistance* (Minutes at 370 C.) |
|---|---|---|---|---|---|
| 101 | .025 | .0038 | 101 | 98.5 | 23 |
| 103 | .03 | .0061 | 100.6 | 98.9 | 27 |
| 81 | .035 | .0081 | 102 | 99.9 | 13 |
| 85 | .05 | .0040 | 100 | 97.7 | 80 |
| 31 | .05 | .0080 | 99.1 | 97.5 | 27 |
| 34 | .06 | .0092 | 99.1 | 97.5 | 27 |
| 89 | .065 | .0047 | 98.5 | 96.9 | 45 |
| 92 | .08 | .0063 | 98.4 | 96.8 | 80 |
| PT | .06 | .0130 | 97.5 | 96.0 | 30 |
| 95 | .10 | .0052 | 96.5 | 94.0 | 80 |
| 105 | .15 | .0052 | 90.2 | 88.4 | 150 |
| 107 | .20 | .0057 | 87.5 | 86.6 | 150 |
| C11400 | | | 100 | | 7 |
| C14300 | | | 95 | | 30 |

*Anneal Resistance specified by time (in minutes) to 50% reduction in hardness value at 370° C.

TABLE II

Composition and Conductivity of the Copper-Tin-Selenium Alloys

| Alloy No. | Composition (wt. %) Sn | Se | $O_2$ | Conductivity (% IACS) Annealed | Cold Rolled | Anneal Resistance (Minutes at 370 C.) |
|---|---|---|---|---|---|---|
| 102 | .025 | .01 | .0011 | 96.3 | 93.6 | 55 |
| 104 | .03 | .021 | .0077 | 97.7 | 95.9 | 65 |
| 82 | .035 | .023 | .0063 | 100 | 98.5 | 40 |
| 83 | .035 | .027 | .0043 | 100.2 | 98.5 | 40 |
| 84 | .035 | .043 | .0023 | 97.8 | 96.2 | 60 |
| 86 | .05 | .018 | .0017 | 98 | 96.5 | 300 |
| 87 | .05 | .028 | .0064 | 99 | 98.7 | 60 |
| 88 | .05 | .04 | .0056 | 98.2 | 97.1 | 90 |
| 153 | .05 | .015 | .0160 | 100.5 | — | 4 |
| 123 | .05 | .024 | .0100 | 100.5 | — | 20 |
| 32 | .05 | .028 | .0061 | 98.9 | 96.5 | 70 |
| 33 | .05 | .073 | .0055 | 98.6 | 96.8 | 65 |
| 35 | .06 | .032 | .0057 | 97.3 | 96.0 | 65 |
| 90* | .065 | .016 | .0007 | 83.5 | 82.7 | 200 |
| 91* | .065 | .029 | .0004 | 90.5 | 88.8 | 300 |
| 93 | .08 | .015 | .0019 | 96.0 | 94.2 | 110 |
| 94 | .08 | .029 | .0024 | 96.0 | 94.0 | 100 |
| 96 | .10 | .034 | .0065 | 95.5 | 94.7 | 200 |
| 97 | .10 | .034 | .0240 | 98.5 | — | 15 |
| 97A | .10 | .034 | .0240 | 96.0 | — | 60 |
| 165 | .10 | .031 | .0170 | 96.0 | 94.0 | 20 |
| 106 | .15 | .026 | .0005 | 88.2 | 86.6 | 250 |
| 108 | .20 | .038 | .0008 | 85.3 | 83.7 | 500 |

*These alloys contain a high iron impurity content (>0.02 weight percent) which caused the reduction in electrical conductivity.

TABLE III

Composition, Conductivity and Anneal Resistance of Copper-Tin-Tellurium Alloys

| Alloy No. | Composition (ppm) Sn | Te | O | Conductivity (% IACS) Annealed | Cold Rolled | Anneal Resistance (minutes) |
|---|---|---|---|---|---|---|
| 201 | 500 | 171 | 55 | 99.8 | 98.2 | 480 |
| 202 | 500 | 172 | 64 | 99.8 | 98.2 | 480 |
| 203 | 300 | 286 | 88 | 102.7 | 100.9 | 480 |
| 204 | 300 | 327 | 73 | 102.2 | 100.7 | 480 |
| 205 | 700 | 189 | 99 | 99 | 97.3 | 480 |
| 206 | 700 | 192 | 197 | 102.0 | 99.9 | 480 |

TABLE IV

Mechanical Properties of Copper Alloys at 40% Cold Rolled

| Alloy No. | UTS (psi) | 0.2% YS (psi) | Elong. (%) |
|---|---|---|---|
| 31 | 49,500 | 49,000 | 2.9 |
| 32 | 51,300 | 50,600 | 3.9 |
| 33 | 51,100 | 50,500 | 4.5 |
| 201 | 54,300 | 53,800 | 3.2 |
| 34 | 48,400 | 47,800 | 2.9 |
| 35 | 51,200 | 50,000 | 3.6 |
| 205 | 54,700 | 53,900 | 3.7 |
| 206 | 54,300 | 53,800 | 3.9 |
| CA 11400 | 50,000 | 45,000 | 6 |
| CA 11600 | 50,000 | 45,000 | 6 |
| CA 14300 | 52,000 | 47,000 | 6 |

Having thus described our invention, what we claim as new and desire to secure by Letters Patent is:

1. A copper alloy composition having an improved anneal resistance and minimum electrical conductivity of 95% IACS consisting essentially of copper, oxygen, a sufficient amount of tin that is about 3.7 times the oxygen content plus about 0.025 to 0.08 weight percent, and 0.005 to 0.05 weight percent tellurium.

2. The composition according to claim 1 wherein said composition contains 0.005 to 0.05 weight percent selenium.

3. A copper alloy composition having an improved anneal resistance and minimum electrical conductivity of 90% IACS consisting essentially of copper, oxygen, a sufficient amount of tin that is about 3.7 times the oxygen content plus about 0.025 to 0.15 weight percent, and 0.005 to 0.05 weight percent tellurium.

4. The composition according to claim 3 wherein said composition contains 0.005 to 0.05 percent selenium.

5. A process for preparing anneal resistant high electrical conductivity copper-oxygen-tin-tellurium alloy compositions which comprises the steps of (a) melting a copper base metal.

(b) estimating the oxygen content of the molten copper to determine the amount of tin to be added, (c) adding a sufficient amount of tin that is about 3.7 times the estimated oxygen content plus an excess of between about 0.025 and 0.15 weight percent of free tin along with 0.005 to 0.05 weight percent tellurium.

(d) casting the alloy composition by conventional methods, (e) heating the cast alloy for a sufficient time to achieve the desired hot working temperature range, (f) hot working the heated alloy at a temperature range of from 400° C. up to within 50° C. of the melting temperature of the alloy, to a reduced section thickness of up to 95%, (g) cold rolling the hot worked alloy to a reduced section thickness of up to 95%, and (h) conducting an intermediate anneal of the cold worked alloy for a time between 10 seconds and 12 hours at a temperature range of 300° to 850° C.

6. The process according to claim 5 wherein the annealed alloy of step (h) is further processed by repeating steps (g) and (h) as many times as necessary to achieve a desired thickness.

7. The process according to claim 5 wherein the annealed alloy of step (h) is further processed by cold rolling to a reduced section thickness of up to 90% to achieve a finish dimension.

8. The process according to claim 6 wherein the annealed alloy of step (h) is further processed by cold rolling to a reduced section thickness of up to 90% to achieve a finish dimension.

9. The process according to claim 5 wherein said hot working step is preferentially carried out at temperatures between 800° and 900° C.

10. The process according to claim 6 wherein said hot working step is preferentially carried out at temperatures between 800° and 900° C.

11. The process according to claim 7 wherein said hot working step is preferentially carried out at temperatures between 800° and 900° C.

12. The process according to claim 8 wherein said hot working step is preferentially carried out at temperatures between 800° and 900° C.

13. The process according to claim 5 wherein said copper-oxygen-tin-tellurium alloy composition has an improved anneal resistance, an excess weight percentage of about 0.025 to 0.08 free tin along with 0.005 to 0.05 weight percent tellurium so as to produce a minimum electrical conductivity of 95%, and said intermediate anneal is carried out at 500° C. or above for a sufficient time to reach a desired grain size.

14. The process according to claim 13 wherein said copper-oxygen-tin-tellurium alloy composition also contains 0.005 to 0.05 weight percent selenium.

15. The process according to claim 5 wherein said copper-oxygen-tin-tellurium alloy composition has an improved anneal resistance, an excess weight percentage of about 0.025 to 0.15 free tin along with 0.005 to 0.05 weight percent tellurium, so as to produce a minimum electrical conductivity of 90% IACS, and said intermediate anneal is carried out at 500° C. or above for a sufficient time to reach a desired grain size.

16. The process according to claim 15 wherein said copper-oxygen-tin-tellurium alloy composition also contains 0.005 to 0.05 weight percent selenium.

17. An article suitable for use as radiator fin, electrical connector, or commutator segment stock which is comprised of a copper alloy composition having an improved anneal resistance and minimum electrical conductivity of 95% IACS consisting essentially of copper, oxygen, a sufficient amount of tin that is about 3.7 times the oxygen content plus about 0.025 to 0.08 weight percent and 0.005 to 0.05 weight percent tellurium, and which is further rolled, cut, stamped, machined, or otherwise fabricated into a final shape.

18. The article according to claim 17 wherein said copper-oxygen-tin-tellurium alloy composition also contains 0.005 to 0.05 weight percent selenium.

19. An article suitable for use as radiator fin, electrical connector, or commutator segment stock which is comprised of a copper alloy composition having an improved anneal resistance and minimum electrical conductivity of 90% IACS consisting essentially of copper, oxygen, a sufficient amount of tin that is about 3.7 times the oxygen content plus about 0.025 to 0.15 weight percent and 0.005 to 0.05 weight percent tellurium, and which is further rolled, cut, stamped, machined, or otherwise fabricated into a final shape.

20. The article according to claim 19 wherein said copper-oxygen-tin-tellurium alloy composition also contains 0.005 to 0.05 weight percent selenium.

21. A method for improving the anneal resistance of copper-oxygen alloys which comprises adding a sufficient amount of tin to stoichiometrically combine with all the oxygen in the alloy and further provide an excess of free tin of about 0.025 to 0.08 weight percent, along with a tellurium addition of about 0.005 to 0.05 weight percent so as to produce a copper-oxygen-tin-tellurium alloy having improved anneal resistance along with a minimum electrical conductivity of 95% IACS.

22. The method according to claim 21 wherein said copper-oxygen-tin-tellurium alloy further comprises 0.005 to 0.05 weight percent selenium.

23. A method for improving the anneal resistance of copper-oxygen alloys which comprises adding a sufficient amount of tin to stoichiometrically combine with all the oxygen in the alloy and further provide an excess of free tin of about 0.025 to 0.15 weight percent, along with a tellurium addition of about 0.005 to 0.05 weight percent so as to produce a copper-oxygen-tin-tellurium alloy having improved anneal resistance along with a minimum electrical conductivity of 90% IACS.

24. The method according to claim 23 wherein said copper-oxygen-tin-tellurium alloy further comprises 0.005 to 0.05 weight percent selenium.

* * * * *